US005294031A

United States Patent [19]

Volpei et al.

[11] Patent Number: 5,294,031

[45] Date of Patent: Mar. 15, 1994

[54] DISCREET PISTOL POUCH

[76] Inventors: Mark D. Volpei, 135 Tuolomne Ave., Ventura, Calif. 93004; Joe Evans, 495 S. La Luna, Ojai, Calif. 93023

[21] Appl. No.: 802,525

[22] Filed: Dec. 5, 1991

[51] Int. Cl.[5] ..... A45C 1/04

[52] U.S. Cl. ..... 224/229; 224/192; 224/196; 224/228; 224/238; 224/243; 224/911

[58] Field of Search ..... 224/192, 196, 224, 226, 224/227, 228, 229, 237, 238, 239, 240, 241, 242, 243, 250, 253, 151, 202, 901, 911; 150/101, 112; 190/101, 118, 120, 100; 343/97; 70/68, 312

[56] References Cited

U.S. PATENT DOCUMENTS

| | | | |
|---|---|---|---|
| 4,029,243 | 6/1977 | Zerobnich et al. | 224/224 |
| 4,258,871 | 3/1981 | McMahon | 224/911 X |
| 4,446,574 | 5/1984 | Kalomeris | 224/229 X |
| 4,466,537 | 8/1984 | McMahan | 206/3 X |
| 4,515,300 | 5/1985 | Cohen | 224/151 |
| 4,523,703 | 6/1985 | McKenna | 224/224 |
| 4,750,655 | 6/1988 | Barry | 224/243 |
| 4,867,215 | 9/1989 | Macieowitz | 190/101 X |
| 4,966,320 | 10/1990 | DeSantis et al. | 224/229 |
| 4,982,883 | 1/1991 | Ullal et al. | 224/224 X |
| 4,998,653 | 3/1991 | LaBelle | 222/226 X |

FOREIGN PATENT DOCUMENTS

| | | | |
|---|---|---|---|
| 2559040 | 8/1985 | France | 224/224 |

OTHER PUBLICATIONS

Pierre Cardin 5 Piece Lightweight Luggage Collection, received in Group 240 Sep. 27, 1984.

*Primary Examiner*—Henry J. Recla
*Assistant Examiner*—Glen T. Barrett
*Attorney, Agent, or Firm*—Boniard I. Brown

[57] ABSTRACT

A concealed gun holster, primarily to be worn by off duty law enforcement personnel, is modeled after the popular sports fanny packs. The modified pack, held in place with an integral belt, is designed to conceal a hand gun holster for either left or right hand use. A snap release secures the weapon snugly in the holster, yet releases with the same feel and pressure as commonly used police holster releases. A hidden pocket, interior to the pack, may be used to hold a clip of ammunition. The integral belt used to wear the pack comprises zippered pockets which are suitable for storing ammunition, hand cuffs, or other equipment.

2 Claims, 2 Drawing Sheets

DISCREET PISTOL POUCH

BACKGROUND

The present invention relates to handgun holsters, and particularly ones which are disguised to appear as popular sports sacks. The external appearance of the present invention is virtually identical to commonly worn hip packs.

Off duty law enforcement officers and security personnel, or persons in those fields working incognito frequently have reason to carry a concealed weapon. The present invention is a belt pack, commonly called a "fanny pack", which contains a pistol holster, spare magazine pocket, and equipment storage pockets. The gun, not visible when the pack is worn closed, may be quickly accessed by opening the pack's main pouch.

The present invention offers several advantages over preceding methods of gun concealment. No jacket or heavy outer garment need be worn by the individual wearing a concealed gun. The invention, despite its visible evidence, does not attract undue attention because it is identical in shape and styling (including manufacture identification) to currently available sport bags. The bag's padded backing and wide belt offer wearing comfort while one engages in sporting activities. The present gun carrier is ideal for those individuals who must be armed while jogging, cycling or walking. This is particularly important to law enforcement and security professionals who frequently exercise.

An internal stiffener maintains the generally rectangular shape of the pouch to further disguise the contents. Lateral and exterior pockets, along with tie straps, are integrated into the belt and provide additional storage space Gun holsters and hip packs are referred to in U.S. Pat. Nos. 4,258,871, 4,260,087, 4,377,249, 4,466,537, 4,480,776, 4,515,300, 4,579,265, 4,750,655, 5,054,671 and Swiss patent number 624,295, all of which are incorporated herein by this reference.

The above referenced patents, however, do not use a holster, having a snap releasable gun restraint, incorporated into a sport pack of common appearance. None of the referenced patents teach of accessory pockets forming part of a gun pouch's belt, nor an interior pocket for storing extra cartridges or the like.

The problem of providing an inconspicuous externally worn gun carrier has presented a challenge to designers. The development of a belt pouch which, while appearing similiar to commonly worn sport bags, conceals a gun, cartridges, handcuffs, and other law enforcement or security paraphernalia, would represent a major advance in weapon concealment technology and would satisfy a long felt need in the field of carrying arms while out of uniform or under cover.

SUMMARY OF THE DISCLOSURE

The present method for concealing and carrying a pistol and equipment solves the above referenced problems and satisfies the noted needs. The present invention offers a simple solution to the problem of off duty peace officers and incognito security personnel not having a suitably convenient and well disguised gun and equipment carrier.

The present invention is based upon a "fanny pack", or zippered pouch with an integrated belt, which externally is identical, including manufacturers logo, to those in common circulation. Hidden inside the main compartment, however, is a novel system for holding a pistol, with a snap release mechanism similar to those used on standard police holsters. Additional features of the present invention include an auxiliary pocket for extra ammunition and a main compartment zipper which can be locked together by its zipper slider tabs. This locking feature is especially important when the pistol pouch is in the presence of children.

Also, the integration of gadget pockets into the belt provide for storage of commonly used equipment: handcuffs, badges, mace, money, and keys. Outer loops sewn to the belt pockets also serve to hold handcuffs, batons and the like.

These and other features, aspects, and advantages of the present invention will become better understood with reference to the following description, appended claims, and accompanying drawings.

DRAWINGS

FIG. 1 is a perspective view of the gun pouch with the integrated belt pockets and removable holster. The holster in this view is positioned such that a left handed user, wearing the pouch on their abdomen, could conveniently remove the weapon. A front zippered pocket and manufacturers logo are visible on the front panel.

FIG. 2 is a detail view of the pistol holster. The two halves of the snap retainer are affixed to the hook and loop material along the holster sides. A stiffener band forms the holster's leading edge. This figure, as in FIG. 1, shows a holster set up for a left handed shooter. A pistol is shown being withdrawn.

FIG. 3 is a frontal view of the gun pouch in a fully opened position. Two belt pockets are shown as well as accessory loops are shown. An interior pocket, with an optional stiffener insert, is located in the center of the pouch. The pistol holster, using various hook and loop strips, is positioned for a right handed shooter wearing the pouch on their abdomen.

DETAILED DESCRIPTION OF THE INVENTION

Figure 1:
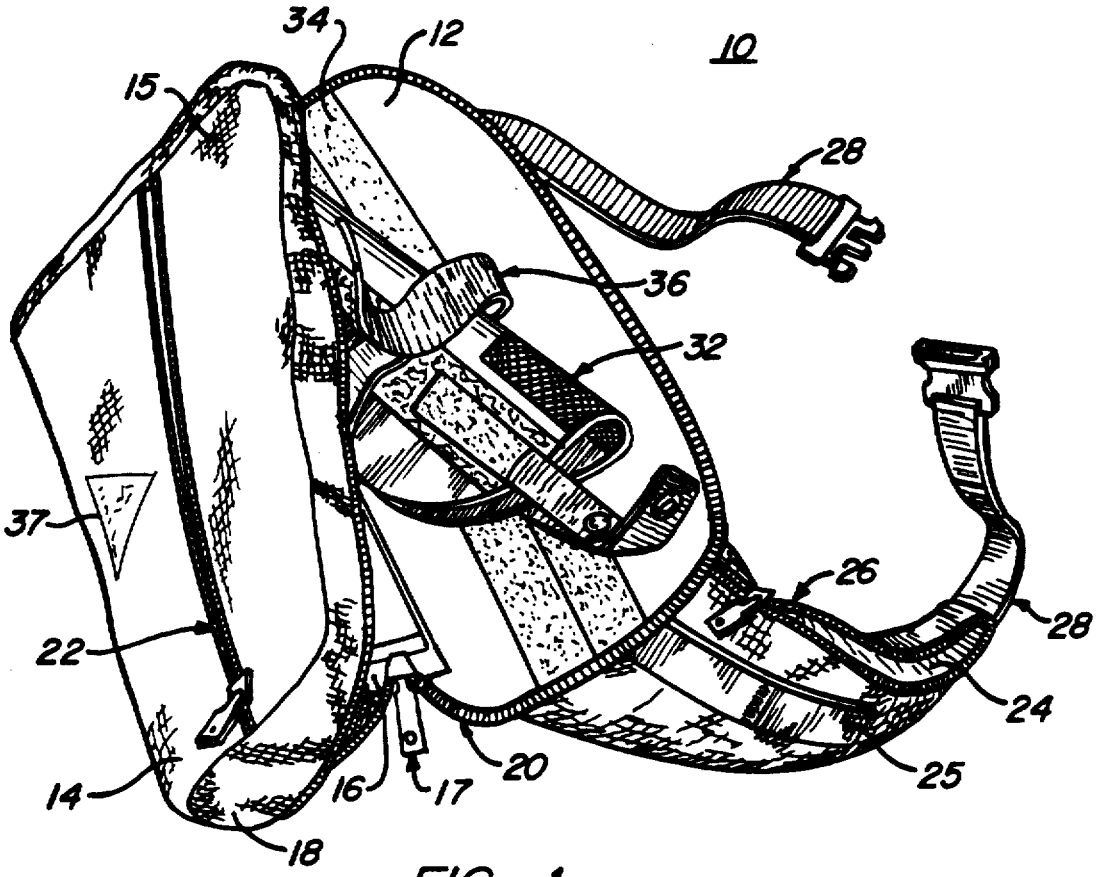

With reference to FIG. 1, a perspective view of the gun pouch 10 in the opened position is shown. The body panel 12, the front panel 14, and the top and side panel or (peripheral edge wall) 18 are all visible. The front pocket flap 15 and a small portion of the bottom panel (or lower edge connector wall) 16, which make up part of the pouch 10, are shown. A zipper closure 20, which can be opened or closed by a pair of zipper runners (or slide elements) 17, 19 (FIG. 3), divides the entire length of the top and side panel 18 in the preferred embodiment.

The front panel 14, which may have several layers of material, joins with and separates from the front pocket flap 15 via a front pocket zipper 22. Equipment may be stored in the front pocket formed behind front panel 14 and front pocket flap 15. The pocket flap 15 may be of contrasting color with respect to the remainder of the pouch 10. The preferred gun pouch 10 is manufactured by Alpenlite of Ventura, Calif., and has a leather logo patch 37 sewn to the front panel 14.

The preferred dimensions of the gun pouch 10, manufactured by Alpenlite, are eight to 11 inches wide, five to eight inches high, and two to five inches deep. The preferred material throughout is nylon pack cloth, sewn through, and with the edges cut hot to sear them and prevent fraying. Zippers are nylon coils, self healing, with metal runners. A black or neutral colored pack cloth is desirable to minimize the attention which is drawn to the pouch 10. The desired weight of the empty pouch 10 is less than one pound.

Hollow belt pockets 24 are attached at one end to the body panel 12 and at a second end to belt straps 28. Preferably, one belt pocket 24 is attached to either side of the body panel 12. One belt pocket 24 should be large enough to hold a pair of handcuffs or wallet, and each pocket 24 has a belt zipper access 26 and accessory loops 25. The accessory loops 25 are lengths of nylon webbing sewn to the belt pockets 24 at three points. The belt straps 28 are adjustable in length to fit the waists of various wearers.

Strips of Velcro® or similar material (fibrous hook and loop fastener material) 34 are longitudinally attached to the concealable surface of the body panel 12. Along the height of the body panel 12, and approximately bisecting the longitudinal strips 34, a holster loop (or retainer strap means) 36 of Velcro® may be fastened or unfastened to secure a holster 32. As seen in FIG. 1, the retainer loop 36 is defined by two straps that overlap gun holster 36 after the holster has been mounted on fastener strips 34. The holster 32 shown in FIG. 1 is positioned to be comfortable for a left handed shooter while the pouch 10 is worn in front of the user's body.

Figure 2:
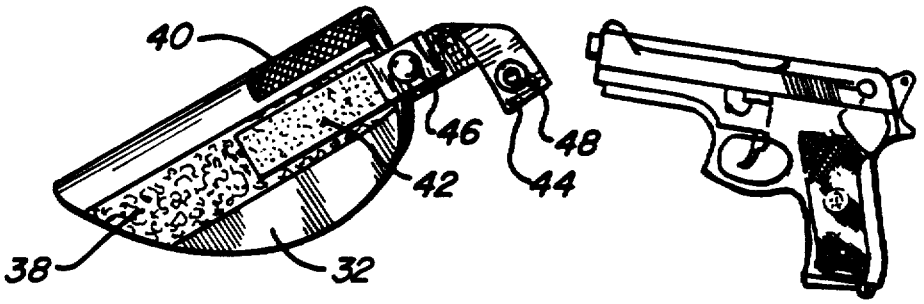

With reference to FIG. 2, a holster 32 is shown open, and with a gun being withdrawn. The holster 32 has two holster longitudinal strips of Velcro® 38, one running along each side of the holster 32. These holster strips of Velcro® (fibrous hook and loop fastener material) are intended to mate with the body panel strips 34 and holster loop 36 (see FIGS. 1, 3) to position and secure the holster 32 relative to the body panel 12. The holster strips 38 also serve as attach points for inner gun retainer strip 44 and outer gun retainer strip 42, which are both partially Velcro® covered nylon pieces. The inner gun retainer strip 44 has a male snap 48 at one end, while the outer gun retainer strip 42 has a female snap 46 at one end.

The inner gun retainer strip 44 and the outer gun retainer strip 42 are both removably attachable to holster strip 38; one is on either side of the holster 32. The inner gun retainer strip 44 shall be sandwiched between the holster 32 and the body panel 12 irrespective of how the holster 32 is positioned on the body panel 12. The outer gun retainer strip 42 shall be attached to the side of the holster 32 opposite that which contains the inner gun retainer strip 44. The outer gun retainer strip 42 must be oriented such that the closed end of the female snap 46 faces away from the body panel 12. The orientation of the inner gun retainer strip 44 must allow the male snap 48 to mate with the female snap 46 only after the inner gun retainer strip 44 is bent through 180°. This arrangement allows the holster 32 to be attached to the body panel 12 so that either a left or right handed shooter may release the gun retainer snaps 46, 48 with one thumb. The preferred snaps 46, 48 are manufactured by TRW and are approved by the Department of Transportation, though any similar snaps will work equally well.

The holster 32 is constructed of fabric, preferably nylon or another abrasive resistant material. The fabric is folded to form an open envelope, which is sewn shut along only a portion of its periphery. An entry stiffener 40 is sewn along the folded edge of the holster 32 which first contacts the gun. The entry stiffener 40 is preferably of a heavier weight nylon fabric than the holster body 32, and may be doubled back on itself. The stiffener 40, which may also contain plastic or cardboard, is designed to maintain an adequate opening in the holster 32 for easy insertion and retrieval of a weapon.

Figure 3:
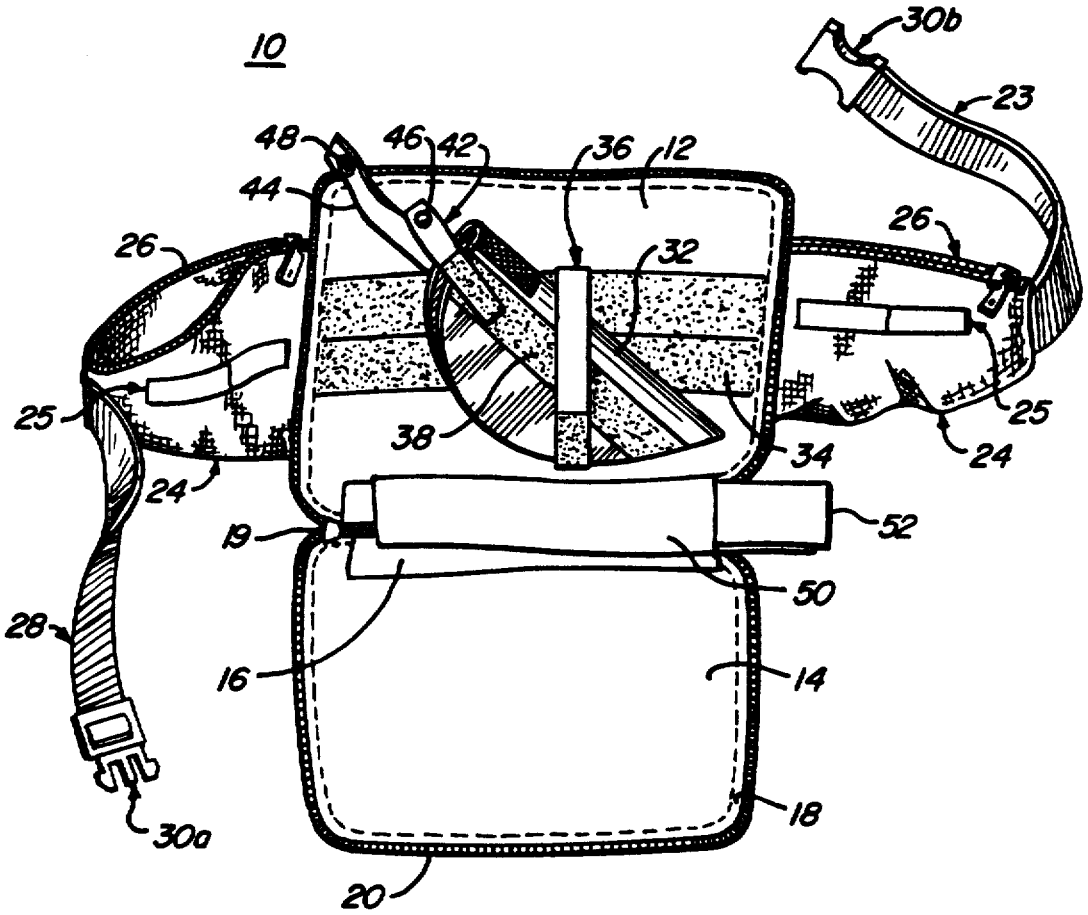

Referring to FIG. 3, a frontal view of the gun pouch 10 in a fully opened position is shown. The holster 32 in this view is adjusted to be comfortable for a right handed user, the pouch being worn on the abdomen, and is secured to the body panel 12. Velcro® body panel strips 34, holster loop 36 and holster strips 38 interact to firmly position the holster 32 wherever the user desires on the body panel 12. The inner 44 and outer 42 gun retainers and the female 46 and male 48 snaps are located to allow a right handed user quick access to the pistol.

The pouch 10 in FIG. 3 is seen fully open, as it would normally be when the gun is used. The zippered closure 20 which separates the top and side panel 18, allowing the bottom panel 16 to hinge the front panel 14 to the body panel 12, is open. The second of the two zipper sliders 19 is visible, while the first zipper slider 17 is visible in FIG. 1. The inside pocket 50 is clearly visible and may be used to store spare magazines, cartridges, or the like. An optional bottom stiffener 52 is partially inserted into the inside pocket 50. The bottom stiffener 52 is made of closed cell foam and aids in maintaining an innocuous pouch shape when the pouch 10 is closed. The stiffener 52 may be removed to allow additional storage space in the inside pocket 50.

Outboard each side of the pouch 10 belt pockets 24, terminating into belt straps 28 are shown; one belt access zipper 26 is open and one is closed. The belt strap's 28 length is adjustable. The accessory loops 25, which hang from each belt pocket 24 are visible. The preferred belt hooks **30*a*, 30*b*** are of high impact plastic and are manufactured by FASTEX of Des Plaines, Ill. 60016 (see U.S. Pat. Nos. 4,150,464 and 4,171,555), though other fasteners will function suitably.

The invention now being fully described, it will be apparent to one of ordinary skill in the arts that many changes and modifications can be made without departing from the spirit or scope of the present invention.

What is claimed is:

1. A lockable handgun pouch adapted to be worn on a person's abdomen, said pouch comprising:

a body panel having an upper edge, a lower edge, and two side edges, a front panel having an upper edge, a lower edge and two side edges, a peripheral edge wall extending rearwardly from the upper and side edges of said front panel toward the corresponding edges of the body panel, a lower edge connector wall means hingedly joining the lower edge of the front panel to the lower edge of the body panel, whereby the front panel can be swung down to expose the body panel and pouch interior, mating rows of interlockable plastic zipper teeth extending along said peripheral edge wall and the upper and side edges of said body panel, two zipper slider elements movable along said mating zipper teeth, each slider element being movable along an entire side edge of the body panel and about halfway along the upper edge of the body panel, whereby the slider elements meet at a midpoint along the body panel upper edge, the slider elements being independently operable to expose selected areas of the body panel, an elongated patch of fibrous hook and loop fastener material extending along said body panel for the entire distance between the body panel side edges, a gun holster having two spaced side walls to form a gun receiver pocket, said holster having a length extending parallel to a direction of insertion of the gun into the gun receiver pocket, a strip of fibrous hook and loop fastener material extending a substantial distance along each side wall of the holster parallel to the holster length dimension, each such strip of fastener material being attachable to said elongated patch of fibrous fastener material on the body panel, whereby the holster is mountable in a plurality of different positions on said body panel, and retainer strap means attached to the body panel for extension about the mounted holster and attachment to said strips of hook and loop fastener material on said holster side walls, and wherein said lower edge connector wall means comprising two spaced walls forming an elongated concealed pocket, said elongated concealed pocket having an access opening at one end thereof in near proximity to the endmost zipper teeth, whereby said elongated pocket is accessible only when one of said slider elements is moved to a fully open position relatively close to the pocket access opening.

2. A handgun pouch according to claim 1, and further comprising:

two belt sections extending from the side edges of said body panel and extending about the person's waist, whereby the pouch is firmly positioned against the person's abdomen, each of said belt sections comprising upwardly opening pocket means for storing articles therein and being contiguous to an associated side edge of the carrier, each pocket means having an open mouth extending along an upper edge, and zipper means extending along each said open mouth to provide access to the associated pocket means.

* * * * *